United States Patent [19]

Okamoto et al.

[11] Patent Number: 4,604,320

[45] Date of Patent: Aug. 5, 1986

[54] ULTRAFINE SHEATH-CORE COMPOSITE FIBERS AND COMPOSITE SHEETS MADE THEREOF

[75] Inventors: Miyoshi Okamoto, Takatsuki; Hiromichi Iijima, Otsu; Akito Miyoshi, Kusatsu, all of Japan

[73] Assignee: Toray Industries, Inc., Tokyo, Japan

[21] Appl. No.: 768,730

[22] Filed: Aug. 23, 1985

Related U.S. Application Data

[60] Division of Ser. No. 678,386, Dec. 6, 1984, Pat. No. 4,557,972, which is a continuation of Ser. No. 347,623, Feb. 10, 1982, abandoned, which is a continuation-in-part of Ser. No. 338,978, Jan. 12, 1982, abandoned.

[51] Int. Cl.[4] ..... B32B 27/00

[52] U.S. Cl. ..... 428/290; 428/254; 428/260; 428/297; 428/303; 428/373; 428/423.1; 428/904

[58] Field of Search ..... 428/254, 260, 297, 303, 428/373, 423.1, 904, 290

[56] References Cited

U.S. PATENT DOCUMENTS

| | | | |
|---|---|---|---|
| 4,008,344 | 2/1977 | Okamoto et al. | 428/373 |
| 4,059,949 | 11/1977 | Lee | 428/373 |
| 4,073,988 | 2/1978 | Nishida et al. | 428/904 |
| 4,350,006 | 9/1982 | Okamoto et al. | 428/373 |
| 4,381,335 | 4/1983 | Okamoto | 428/373 |
| 4,468,434 | 8/1984 | Sekimoto et al. | 428/373 |

*Primary Examiner*—James J. Bell

*Attorney, Agent, or Firm*—Austin R. Miller

[57] ABSTRACT

Improved ultrafine sheath-core composite fibers and composite sheets composed of these fibers are disclosed. The composite fibers have a fineness of 0.0001 to 0.5 denier and comprises 10 to 70% of the core having a very high intrinsic viscosity within a specific range and being located at the center of the sheath and 90 to 30% of the sheath composed of a polyester copolymerized 1.5 to 8 mole %, based on the total acid component, of 5-sodium (or lithium or potassium) sulfoisophthalate and having a thickness of 0.04 to 2 microns. The composite fibers have a high strength and are dyeable with a cationic dye. When the composite fibers are combined with an elastic material such as polyurethane, suede-like artificial leathers having excellent softness, touch, feel and color can be obtained.

4 Claims, 7 Drawing Figures

ULTRAFINE SHEATH-CORE COMPOSITE FIBERS AND COMPOSITE SHEETS MADE THEREOF

BACKGROUND OF THE INVENTION

This is a division of a patent application entitled ULTRAFINE SHEATH-CORE COMPOSITE FIBERS AND COMPOSITE SHEETS MADE THEREOF, Ser. No. 678,386 which was filed on Dec. 6, 1984, by the same applicants U.S Pat. No. 4,557,972 continuation of Ser. No. 347,623, Feb. 10, 1982, abandoned, which is a continuation-in-part of Ser. No. 338,978, Jan. 12, 1982, abandoned.

Ultrafine fibers and artificial leathers prepared by using ultrafine fibers are known. In the case of artificial leathers made of ultrafine polyamide fibers, such as nylon 6 raised fibers are readily entangled and a beautiful appearance can hardly be obtained. Polyacrylonitrile ultrafine fibers are dissolved in a polyurethane (referred to PU hereinafter) solvent or deteriorated there. In general, polyester ultrafine fibers such as polyethyleneterephthalate (referred to PET hereinafter) ultrafine fibers give a harder or stiffer suede-like artificial leather because of the relation between PU binder and the fibers than an artificial leather made of nylon 6 or nylon 66 ultrafine fibers. Moreover, the artificial leather made of polyester ultrafine fibers such as PET is defective in that the fibers cannot be dyed with a cationic dye and a brilliant dyed colour cannot be obtained and that the softness of raised fibers is not enough. Moreover, the polyester ultrafine fibers can hardly be dyed in a deep colour with disperse dye keeping the colour fastness and hence, the dying cost is increased.

Moreover in general one must use such more amount of disperse dye than cationic dye.

A cationic dyeable polyester ultrafine fiber is very weak in strength and does not give strong artificial suede. A cationic dyeable polyester which is copolymerized sufficient to be dyed in deep colour has not enough fiber strength even if the degree of the polymerization is increased to the limit of spinnability.

SUMMARY OF THE INVENTION

We, the inventors became aware of the following objects for the first time. The objects are to develop ultrafine fibers capable of providing a strong suede-like artificial leather on woven or knitted fabric, capable of being dyed with a cationic dye and hence, being coloured brilliantly and deeply, at reduced costs, and also capable of being formed into flexible products excellent in the softness of touch.

As a cationic dye dyeable polyester, a copolymer comprising 5-sodium (or lithium or potassium) sulfoisophthalate (referred to 5-SS hereinafter) can be mentioned. When an artificial leather was prepared according to known means from these ultrafine fibers which were prepared from this copolymer, it was found that an artificial leather having a sufficient strength could not be obtained because the fibers are too weak. If the ratio of copolymer was reduced, a deep or brilliant colour could not be obtained.

Moreover, it was found that even if the degree of the polymerization was increased to a critical level allowing production of ultrafine fibers, it was impossible to impart a sufficient strength to the resulting fibers.

Furthermore, it was found that when a cationic dye dyeable or acid dye dyeable polyamide was used, raised fibers were readily entangled by rub or chafe in practical use and the fastness of dyeing was poor, and an intended product could hardly be obtained.

In short, ultrafine fibers having a thickness of 0.0001 to 0.5 denier and being capable of satisfying above-mentioned objects could not be found.

At first, we tried an ultrafine fiber comprising a core composed of a cationic dye dyeable polyester and a sheath composed of PET as reinforcing (covering) component. But we could not dye substantially the fiber. Because we thought that cationic dye does not diffuse through PET sheath, we tried as sheath component, blended polymers comprising PET and a small amount of core component (5-SS copolymerized PET) to improve the diffusion of cationic dye into the core component, but the core could not be dyed substantially.

Therefore as extraordinary means, we considered ultrafine composite fibers comprising a sheath composed of a cationic dye dyeable polyester and a core composed of reinforcing component. However, many other skilled persons in the art denied the above consideration saying that in such composite fibers, if there is present a weak component on the periphery, once the outer weak component is broken or cracked, crack or break is easily propagated from the weak component to the core component and the sufficient strength cannot be obtained.

In the case of an ordinary denier polyester comprising a sufficient amount of copolymerized 5-SS units, the so called "frosting" phenomenon, that is, whitening of fiber surfaces by fibrillating of the fibers, readily takes place, and therefore it has been mentioned difficult to obtained a satisfactory product from such polyester.

We, the inventors discovered a common domain which satisfies simultaneously improved fiber strength and deep and brilliant colour by cationic dye dyeing by means of following features; (a) a polyester type sheath-core ultrafine composite fiber wherein (b) fineness is 0.5–0.0001 denier (c) the core component is located substantially at the center of the sheath component (d) the specified core component is substantially composed of PET having a surprisingly high IV-value, as defined in the specification of 0.75–1.2 or polybutyleneterephthalate (referred to PBT hereinafter) having a surprisingly high IV-value as defined in the specification of 0.85–2.5 and the sheath component is substantially composed of a specified polyester copolymerized with 5-SS component, (e) the core/sheath weight ratio is in the narrow range of from 10/90 to 70/30 and a thickness of the sheath is extremely limited 0.04 to 2 micron and (f) the 5-SS component is copolymerized in amount of 1.5 to 8 mole % based on the total acid component. Moreover we discovered many unexpected effects that frosting phenomenon does not become actual problem due to the specified ultrafine fiber, and when applied to artificial leather it has very soft hand and good touch of nap in the relation between PU and said fibers.

Furthermore we achieved the reduction of dyeing cost and also we found, when an ordinary polyester was used as the core component, it was found that the intended objects of the present invention could not be attained at all.

DESCRIPTION OF THE PRIOR ARTS

U.S. Pat. No. 4,059,949 discloses a composite yarns exhibiting heather dyeing capability, which is comprised of two groups of filaments composed of two differently dyeable polymers, and it is taught that one of structures for such yarns is a concentric sheath-core structure. However, in this prior art, use of ultrafine fibers is not shown, and a method of producing of ultrafine fibers is not taught at all. Moreover, it is not taught at all in this prior art that specific PET having a ultra-high degree of polymerization, referred to in the present invention, is used in a appropriate amount. Because the object of this prior art is heather dyeing. Therefore, it is not necessary to particularly increased the strength of the fibers, since the fibers have an ordinary denier and a sufficient fiber strength. Moreover, other fibers having an ordinary denier are inevitably mixed with the foregoing fibers, furthermore, it is required that the sheath component should be much thicker than two microns. In view of this requirement it is apparent that ultrafine fibers cannot be provided at all according to the above prior art technique and various unexpected effects attained by the present invention are not disclosed by this prior art technique at all.

U.K. Patent Application No. GB 2057344A previously filed by us discloses a spinneret for production of three component islands-in-a sea type fibers in which the island component is composed of sheath-core type ultrafine fibers. However, this prior art is irrelevant to the objects and effects of the present invention, though the apparatus used is somewhat pertinent to the apparatus used in the present invention.

In British Patent No. 1,313,767, we previously proposed a process in which ultrafine fibers having crimps developed thereon are prepared by three component spinning method. The ultrafine fibers obtained according to this prior art technique have an eccentric structure, and the developing of crimps is intended. Accordingly, this prior art is apparently different from the concept of the present invention in the features and the effects. Moreover, specific ultra high polymerization degree and specified ratio of the core component in the present invention are not disclosed at all, and thickness of the core component in the above prior art is different from that specified in the present invention.

DETAILED DESCRIPTION OF THE PREFERRED EMBODIMENTS

Figure 1:
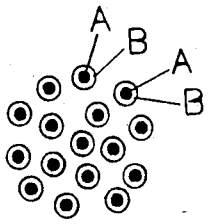
FIG. 1 is a diagram illustrative example of the section of ultrafine composite fibers of the present invention having a sheath-core structure.

The present invention related to ultrafine sheath-core type composite fibers and united bundle thereof and composite sheets thereof.

Polyester comprising 5-SS unit as comonomer unit is dyeable with cationic dye. However, if ultrafine fibers having a size smaller than 0.5 denier are prepared from this polyester, the strength is drastically reduced, and therefore, such ultrafine fibers have no substantial practical utility. Furthermore, since these ultrafine fibers are poor in the strength, they are not suitable for production of a suede-like sheet, which is one of important uses of this type, because the fibers to be raised are cut off at the buffing step and intended raised fibers cannot be obtained. For these reasons, for the time being, such copolyester is industrially used only in the form of ordinary fiber denier.

Furthermore, spinning of such polyester is difficult, and in case of ultrafine fibers, this difficulty is increased seriously.

One of the objects of this invention is to obtain a fiber, capable to be less than 0.5 denier, having enough strength for practical use and enough clouring build up properties. Such fibers could be expected to be suitable for excellent artificial suede or the like or silk-like fabric and artificial furs like chinchilla fur or mutton fur or mink etc. Ultrafine fibers are indispensable to some kinds of furs. The large denier fibers are not enough to these fabrics.

In artificial leather suedes (non-woven fabrics or woven fabrics or knitted fabrics or those combinations) an raised fabrics (inclusive of flocked fabrics and non-woven fabrics formed according to the paper-making method) prepared by using polyester ultrafine fibers, we thought it necessary to develop ultrafine fibers capable of providing high-grade products excellent in slipperiness or having a moist, dewy, somewhat oily hand similar to natural suede and use such ultrafine fibers for production of the forgoing products.

It was found that when an oiling agent or a silicone finishing agent is applied to artificial leathers, the intended slipperiness cannot be attained and even if a certain feel is obtained, it is readily removed by washing or the like.

We also considered it necessary to use ultrafine polyester fibers having a low modulus which does not strongly adhere to a polyurethane (especially, a wet coagulated product). The reason is that a high elasticity and softness should be imparted to a product. More specially, we noted that a natural leather is widely used without being impregnated with a polyurethane or the like and it is used as a suede after buffing, without polyurethane.

In short, natural leathers have excellent properties manifested only by tanning, and impregnation with a polyurethane or the like is unnecessary.

In contrast, most of excellent artificial leathers have passed through the step of impregnation with a resin such as a polyurethane, and it may be said that excellent artificial leathers cannot be obtained without the impregnation treatment.

This is due to the substantial difference of the substrate structure between a natural leather and an artificial leather. For example, the natural leather has a structure including many branches like withered twigs which are entangled with one another, but artificial leathers heretofore provided have only entanglements of short fibers. Accordingly, it is not reasonable to discuss natural leathers and artificial leathers on the same technical field, and the relation between fibers and polyurethane resins are delicate and important in artificial leathers. Novel excellent functions of the intended fibers of the present invention have not been noted heretofore in the art.

We made researches with a view to solving the foregoing problems involved in the conventional techniques and as the result, we have now completed the present invention.

It is a object of the present invention to provide a stronger composite sheet, for example a suede-like sheet, which can be coloured brilliantly and deeply and has a slippery touch and a soft feel and which includes raised fibers resembling those of high quality natural leathers, and preferable fiber construction that can be formed into such composite sheets.

Development of artificial leather suedes is prominent at the present and rather colourful products of a high grade have been provided.

However, we became aware of the importance to further improve the colour brilliance and depth, the touch softness, the feel and the strength.

In short, it may be said that a high-grade product having a satisfactorily brilliant and deep colour has not been marketed nor developed.

Up to this time, artificial leather using polyamide ultrafine fibers and polyurethane is inferior in colour fastness when deeply and brilliantly dyed, and cannot be marketed, and moreover has not high quality feeling because its raised fibers are liable to be entangled. On the other hand, artificial leathers using polyester fibers having brilliant colour are limited because they have serious handicaps that it must be dyed with disperse dye and due to the characteristics of ultrafine fibers. Namely there are unexpected defects on depth, brilliance, colour fastness when ultrafine fibers are used instead of ordinary denier fibers.

It is indeed that we can get much more colour of artificial leather than of natural leather. Nevertheless, a requirement for higher quality were arisen successively in our study.

It might be expected to dye the fabric using copolymerized polyester with 5-SS. However, we have experienced and found out that said copolymerized fiber is weak, and impossible to produce the fabric which has minimum degree of physical properties of for marketing or actual use.

Furthermore, at the step of raising of the fabric by buffing, the fibers to be raised are cut off and intended raised fibers cannot be obtained or the raised fibers are often worn out from the fabric in actual use. For that reason, for a long time, there cannot be found in the market, high quality suede having brilliant colour.

We made diligent researches to satisfy simultaneously such properties as physical properties, colour brilliance, nap, feel, touch and appearance, and at last we have now completed the present invention.

1. In accordance with one fundamental aspect of the present invention, a polyester type sheath-core ultrafine composite fiber wherein (a) the fineness is 0.5 to 0.0001 denier, (b) the core component is located substantially at the center of the sheath component, (c) the core component is substantially composed of polyethyleneterephthalate (referred to PET hereinafter) having an IV value, as defined in the specification, of 0.75 to 1.2 or a Polybutyleneterephthalate (referred to PBT hereinafter) having an IV value, as defined in the specification of 0.85 to 2.5 and the sheath component is substantially composed of a polyester copolymerized with 5-sodium (or lithium or potassium) sulfoisophthalate (referred to 5-SS hereinafter) component, (d) the core/sheath weight ratio is in the range of from 10/90 to 70/30 and the thickness of the sheath is 0.04 to 2 micron, and (e) the 5-SS component is copolymerized in an amount of 1.5 to 8 mole% based on the total acid components.

2. In accordance with another aspect of the present invention, there is provided a three-component type composite fiber comprising several ultrafine composite fibers as set forth above, which are united in a bundle by an interposing third component.

3. In accordance with still another aspect of the present invention, there is provided an ultrafine composite fiber as set forth above, wherein the 5-SS component is copolymerized in an amount of 2 to 2.8 mole% based on the total acid component, and the core/sheath weight ratio is in the range of from 20/80 to 55/45 and the strength is at least 3.8 g/d.

4. In accordance with a further aspect of the present invention, there is provided an ultrafine composite fiber as set forth above, wherein the polyester is one prepared by melt polymerization and subsequent solid phase polymerization.

5. In accordance with a still further aspect of the present invention, there is provided a composite sheet comprising a polyurethane and a fabric in which all or parts of fiber component a ultrafine composite fibers having a fineness of 0.5 denier or less, wherein said ultrafine composite fibers comprise a sheath component and a core component, more than half of the side face of the core component is surrounded by the sheath component, the sheath component is mainly composed of a polyester containing 5-SS and the core component is composed of a polyester formed mainly of PET having an IV value, as defined in the specification, of 0.75 to 1.2 or PBT having an IV value, as defined in the specification, of 0.85 to 2.5, which is free of 5-SS unit or contains said unit at a ratio smaller than in the sheath component.

6. In accordance with a still further aspect of the present invention, there is provided a composite sheet as set forth above, wherein at least the sheath component is dyed with at least a cationic dye.

7. In accordance with a still further aspect of the present invention, there is provided a composite sheet as set forth above, wherein at least the sheath component is dyed with at least a disperse dye and at least a cationic dye.

8. In accordance with a still further aspect of the present invention, there is provided a composite sheet as set forth above, wherein at least sheath component is dyed with, at least a disperse dye, and furthermore the sheet comprising polyurethane.

9. In accordance with a still further aspect of the present invention, there is provided a composite sheet as set forth above, wherein the said sheet after dyeing is washed in two-bath comprising of reduction clearing at PH-value more than 10 and soaping with anionic surface active agent.

This invention is related to the subject of ultrafine fibers having less than 0.5 denier, the technical difficulties and the uniqueness and unexpectedness of the effects.

The ordinary PET or PBT fibers of less than 0.5 denier have not deep colour and there copolymer fibers with 5-SS unit for improvement of the colour are weak and of no or less practical use.

This invention overcomes these defects. In case of more than 0.5 denier, raised fabrics has not good touch and hand, in case of less than 0.5 denier raised fabrics have smooth touch and good hand, and especially, in this invention, the raised fabrics have much more smooth touch and better hand.

This invention satisfies simultaneously improvement of raising effects due to proper fiber strength, low adherence with polyurethane due to specified sheath component, excellent luster due to specified fiber denier and sheath core construction and prevention from frosting phenomenon due to specified fiber denier.

In the present invention, adopting the the above mentioned structure, especially by arranging a core having a very high degree of polymerization in a specific amount of 10 to 70% at the center of the sheath, the strength can be increased to an appropriate level, a brilliant and deep colour can be obtained by dyeing with a cationic dye, furthermore the problem of frosting is not practically significant in the resulting ultrafine fiber fabric, and when this ultrafine fiber is formed into an artificial leather or the like, a product having a very soft feel and a good raised fiber touch can be obtained, because the adherence between the fiber and the polyurethane is not so strong. Thus, various unexpected effects can be attained according to the present invention. Furthermore, the dyeing cost can be remarkably reduced.

The present invention is described in Figs. The cross sectional sheath core structure is shown in FIG. 1. In FIG. 1, A represents the core component and B represents sheath component.

Figure 2:
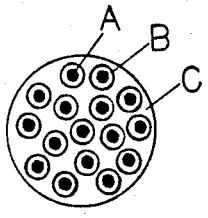
FIG. 2 is a diagram illustrative example of the section of a united bundle (three component composite fiber) of ultrafine composite fibers of the present invention.

FIG. 2 shows a most preferable example of the starting fiber for the preparation of the fiber shown in FIG. 1, that is, a united bundle of the ultrafine fibers in FIG. 1.

For facilitating the understanding, the present invention is described with reference to preferable means for attaining the objects of the present invention, though the present invention is not limited by such means described below. First, a cross section of a three component composite fiber diagrammatically is shown in FIG. 2. In this islands-in-a sea composite fiber, islands constitute sheath core fibers. In FIG. 2, A represent the core of the islands, which is substantially composed of PET, PBT or a copolymer thereof, which has very high degree of polymerization. This polyester does not contains 5-SS units or if these units are contained, the content of these units is lower than in the sheath B. It is ordinary preferred that A is composed of a homopolymer, that is PET or PBT.

The sheath B is substantially composed of a polyester containing 5-SS unit. It is preferred that the sheath B is substantially composed of a copolymer with 5-sodium sulfoisophthalate of the polyester of the core A. It is indispensable that the copolymerization ratio of 5-SS component should be 1.5 to 8 mole%, preferably 1.9 to 5.0 mole%, especially preferably 2 to 2.8 mole%, based on the total acid components. This copolyester is arranged as the sheath of the island component, and it is preferred that the sheath should surround the surface of the core component without high eccentricity, though it may surround the core thinly.

If the surrounding condition is not good, no good colouring properties can be obtained and the fibers become easy to entangle each other by rub or chafe due to crimps.

The copolymer of the sheath component exhibits a high apparent viscosity at the molten state as compared with its intrinsic viscosity IV (described hereafter).

In order to ensure the sufficient strength, it is preferred that the intrinsic viscosity IV of the core component is as high as possible within the allowable range. It is at least indispensable that the intrinsic viscosity of the core component A is higher than that of the sheath component. If this requirement is not satisfied, the intended objects of the present invention cannot be attained. It is preferred that the intrinsic viscosity of the core component is higher by at least 0.1, especially by at least 0.15, than the intrinsic viscosity of the component B. If this requirement is satisfied, a high strength is manifested when the fiber is drawn at an elongation lower than 100%, especially at an elongation of 10 to 65%.

The component C in FIG. 2 is a so called sea component, and if this component is removed as occasion demands, the fiber of the present invention as shown in FIG. 1 is formed. The thickness of the fiber of the present invention is preferably 0.0001 to 0.5 denier, especially preferably 0.25 to 0.05 denier. This requirement influences on the dye fastness, the colouring properties and the touch, and if this requirement is satisfied, the effects of the present invention are most prominent.

The cross-sectional shape of the fiber is not limited to a circular shape but the fiber can take any of cross sectional shapes according to needs.

The intrinsic viscosity is measured, for example, in o-chlorophenol at 25° C. The strength of the ultrafine composite fiber AB of the present invention is at least 3.4 g/d, preferably at least 3.8 g/d.

In order to maintain a sufficient strength, it is indispensable that the ratio of the component A in the fiber AB of the present invention should be 10 to 70% by weight, preferably 20 to 55% weight.

In order to impart a good colouring property, it is indispensable that the thickness of the section of the sheath component, as determined by scanning type electron microscope should be 2 microns or less, preferably 0.04 to 2 microns. In the fiber of the present invention, the core component is not strongly eccentric as a whole.

In order to obtain uniform dyeing and to avoid entanglement of the nap, it is preferred that the crimp is not caused in the sheath-core fiber only by shrinkage under heating. For example, an eccentric structure should not be avoided, but a substantially concentric circular section is adopted so that crimping is not caused.

In the fiber of the present invention, the component B is a copolymer having ethyleneterephthalate or buthyleneterephthalate units as main recurring units and 5-SS units in an amount of at least 1.5 mole% based on the total acid components. If content of the 5-SS units is lower than 1.5 mole%, the tendency of light colouration due to the fineness below 0.5 d is not sufficiently compensated by the deep colouring effect attained by the presence of the 5-SS units, and the slipperiness, touch and softness cannot be improved. In the present invention, this disadvantage of frosting is eliminated by adjusting the fineness of the fiber to 0.5 denier or less.

In the present invention, it is indispensable that a polyester composed mainly of ethylene terephthalate units or butylene terephthalate units should be used as the component A. Furthermore, the intrinsic viscosity of this polyester should be higher by at least 0.08, preferably by at least 0.12, than the intrinsic viscosity of the polyester of the component B. A homopolymer such as polyethelene terephthalate or polybutylene terephthalate is preferable to core component.

By the use of such polyester, the strength can be prominently increased according to the present invention. It is especially preferred that this polyester is prepared by melt polymerization and subsequent solid phase polymerization. The reason is the a product having a high degree of polymerization can easily be obtained and improved physical properties can be obtained, because of reducing formation of by-products by side reactions.

The intrinsic viscosity is one determined in o-chlorophenol as the solvent at 25° C. When the polymer is dissolved in the solvent, heating may be conducted, but the temperature should be adjusted to 25° C. precisely at the time of measurement.

By adopting the structure of the present invention, spinning or drawing can be performed easily without yarn breakage or formation fluffs. In the present invention, a balance of the melt viscosity is much better between the component A and B at the spinning step as compared with the case of composite fiber where the component B without 5-SS have the same intrinsic viscosity.

If the intrinsic viscosities of both the components are close to each other or if the intrinsic viscosity of the core component is low, the strength-improving effect of the present invention is not substantially attained (See Comparative Example given hereinafter). Since the apparent melt viscosity is abnormally increased at the spinning step in case of a component containing 5-SS units at a high content, stable spinnig becomes impossible. In order to eliminate this disadvantage, it is preferred that the intrinsic viscosity IV of the component A is higher by at least 0.08 than the intrinsic viscosity IV of the component B. This feature is also important for increasing the frosting resistance.

It is preferred that the intrinsic viscosity of the component is 0.75 to 1.2 in case of polyethlene terephthalate or 0.85 to 2.5 in case of polybutylene terephthalate.

The spinneret for formation of a three-component fiber having a section as shown in FIG. 2 has already been proposed by one of us, and if this spinneret is used, three-component spinning can be performed very smoothly. The bundle as shown in FIG. 2 ordinarily includes 1 to 10000 fibers, preferably 5 to 250 fibers, especially preferably 10 to 80 fibers. If the sea component C is removed or separated after spinning and drawing, the intended fiber as shown in FIG. 1 is obtained.

Thus, according to the present invention, there is provided an fiber suitable for formation of ultrafine composite fibers. According to the present invention, an ultrafine composite fiber comprising the component A and B can easily be obtained from such fiber by removing the component C. When the final ultrafine fibers are subjected to carding, spinning, weaving, knitting, webbing or flocking, such processes are some times difficult, or troubles were sometimes caused. In such case, there may be easily adopted a method without trouble in which at first a plurality of ultrafine fibers are united by the component C, next the bundle of three component fiber is subjected to such processes, and after then the component C is removed. Furthermore, there may be adopted a method in which a fabric composed of the ultrafine fibers, for example, a non-woven fabric, is impregnated with component C to unite these ultrafine fibers. If necessary, the fabric or the like may be impregnated with another component B as well as the component C. After such impregnation, the component C is removed. The kind of the component is not particularly critical, so far it can be removed by a solvent or decomposing agent or by mechanical means without any significant influence on the composite fiber AB. Namely, the component C may be chosen among various polymers or binders appropriately according to the the intended objects and uses.

In this invention, IV values are measured and defined according to the following methods.

(1) IV Measurement Method A

This method is adopted when the polymer is hardly soluble or the IV value is found to be larger than 1.0 at the preliminary test.

At first, 10 ml of o-chlorophenol is added to 0.8 g of a polmer, and the mixture is immersed in a bath maintained at 160° C. and stirred for 60 min. by a magnetic stirrer to dissolve the polymer. A capillary tube viscometer is charged in a water bath maintained at 25° C., and the flowdown time is measured and the relative viscosity (eta r) is determined from the ratio of the flowdown time. The IV value is calculated according to the following formula:

$$IV = 0.0242(\text{eta r}) + 0.2634$$

(2) IV Measurement Method B: (IV less than 1.0)

The IV value is determined in the same manner as described in the measurement method A except that the mixture of the polymer and o-chlorophenol is immersed in a bath maintained at 100° C. and the polymer is dissolved by applying ultrasonic vibrations for 30 min.

The pure core sample to be subjected to the above-mentioned method A or B is collected by dipping the sheath-core fiber into a 5% solution of NaOH, boiling the solution at one time, dissolving the residue in the solution at about 85° C., performing water washing and then conducting drying at 100° C. The fiber is dissolved in such an amount that the weight of the core component becomes slightly less than the weight of the core component calculated from the core-sheath ratio. Namely, all of the sheath and surface of the core are dissolved off. The sheath is more easily dissolved out than the core because the sheath component contains 5-SS units.

In the present invention, the "intrinsic viscosity IV" is the value determined by the above-mentioned A or B according to the above calculation formula.

Incidentally, the IV value of the polymer is reduced during spinning. Accordingly, the IV value is determined with respect to the fiber according to the above-mentioned method A or B.

The effects of the ultrafine composite fiber of the present invention are as follows.

(1) Since the fiber is ultrafine and the copolymerized 5-SS component-containing polymer is exposed to the surface, a product having a soft touch can be obtained.

(2) The strength is high and practically applicable ultrafine fiber can be provided though this is impossible in case of the fiber composed solely of the component B. This effect of improving the strength is unexpected and surprising and contrary to the ordinary technical concept that the strength of the composite fiber is very strongly influenced by the weaker component.

(3) Since the polymer containing 5-SS is exposed to the surface, a product having a good slipperiness can be obtained.

(4) The Young's modulus is not too high or not too low. If the Young's modulus is too high, the good feel and good touch are reduced, and if the Young's modulus is too low, the touch becomes bad.

(5) The fiber can be dyed with a cationic dye (although the fiber is ultrafine, the fiber can be dyed into a deep and brilliant colour).

(6) The fiber can be dyed with one or more cationic dyes and also with one or more disperse dyes. Of course, with both. Sometimes the fabric is dyed with one or more disperse dyes only.

(7) A special colour effects can be attained by using a mixture of dyes.

(8) When a polyurethane is used, a special feel (soft and somewhat wetty feel) can be given to the product. The reason is that the adhesiveness to the polyurethane is reduced and the synergistic effect can be attained by the 5-SS-containing polymer (in case of wet coagulation).

(9) The fiber can be spun stably and the spinnability is very good in spite of three components.

(10) Occurrence of yarn breakage is substantially prevented at the spinning step.

(11) Occurrence of yarn breakage extremely reduced at the drawing step and formation of fluffs is rare.

(12) The fiber can be mixed with other fibers. Since the strength difference is small, it does not happen that only the fiber of the present invention falls out or is cut out while the product is actually used. This effect is especially prominent when buffing is carried out for the purpose of raising.

(13) Even if the component B is deteriorated by an alkali, the damage is reduced to a very low level because of the presence of the component A (because the component B is combined with the component having a high alkali resistance).

(14) Control of the elongation can be performed very easily.

(15) Frosting is not conspicuous in actual use.

In the present invention, the sheath component (component B) does not only exert the function of surrounding as the cationic dye-dyeable component the ultrafine fiber, but also it has important relation to an elastomer such as a PU and also to the slipperiness, feel and touch when the fiber is processed into an artificial leather. In short, the component B exerts excellent effects.

These effects will now be described while comparing an artificial leather prepared by using the ultrafine composite fiber of the present invention with an artificial leather prepared by using an ultrafine fiber composed solely of 100% PET having an ordinary degree of polymerization.

(1) The product of the present invention can be dyed with a cationic dye, and the dyeing cost can be reduced.

(2) The product of the present invention can be dyed with a cationic dye and also with a disperse dye, and when this dyeing method is adopted, a deep colour having a highest brilliance can be imparted.

(3) The strength of the product of the present invention is higher than the strength of the product composed solely of the component B, and also the sheet strength becomes higher.

(4) By the buffing operation, high quality of raised fibers comparable to those obtained by using PET alone can be obtained.

(5) The touch is softer than the touch of the product obtained by using PET alone. The reasons is that the component B has a much reduced adhesiveness to a polyurethane (ordinary wet coagulation) (the adhesiveness of the component B to the polyurethane is lower than that of component A). And the fiber in this invention has lower modulus than 100% PET fibers. Thus, good softness and bulkiness can be imparted to the product.

(6) Good slipperiness and soft touch can be imparted to the product. Since the fiber of present invention is ultrafine, the product of the present invention should naturally possess such properties. According to the present invention, the effects (5) and (6) can be enhanced beyond expected levels.

The reason is that peculiar effects other than dyeing effect can be exerted by the 5-SS group present in the molecule and the Young's modulus of the portion of the component B is low.

Figure 3:
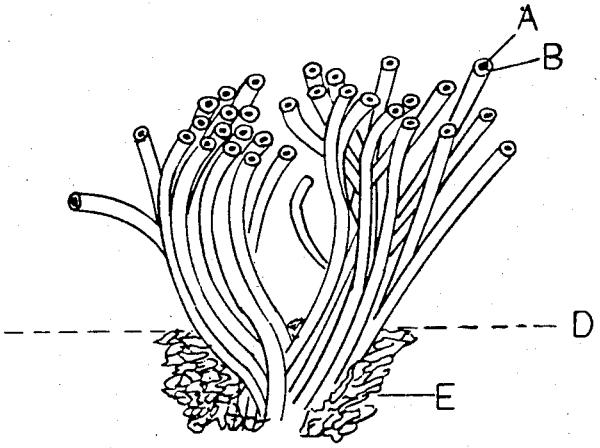
FIG. 3 is an enlarged partial diagram illustrating the surface state of an example of composite sheets (raised product) prepared by using ultrafine composite fibers of the present invention.

FIG. 3 is a view diagrammatically illustrating the raised portion of a raised composite sheet prepared by using the fiber of the present invention. In FIG. 3, D represents the surface of the composite sheet not inclusive of the raised fibers, and E represents a polyurethane elastomer. It is considered that the adhesiveness of the fiber AB to the elastomer E around the fiber are changed. By such change, the fell and touch can further be improved.

If a fabric formed of the ultrafine composite fiber of the present invention is impregnated with a polyurethane, it may be raised or may not be raised. A grain layer composed of polyurethane or other polymer may be formed on the fabric according to need. As the fabric, there may be used a non-woven fabric, a woven fabric, a knitted fabric and combinations thereof. Such fabric need not be composed completely of the ultrafine composite fiber of the present invention, but the fiber of the present invention may be used at an optional ratio or optional parts according to the intended object and use, so far as attainment of the objects of the present invention is not substantially inhibited. In case of a raised product, it is preferred that the majority of the raised portion be composed of the fiber of the present invention.

Since the ratio of impregnation with the PU is changed according to the intended object and use, in general, it is difficult to specify the quantity of the PU. But, for example, in case of a non-woven fabric, the amount of the PU is 15 to 120% by weight based on the fiber, and in case of a woven or knitted fabric, the amount of PU is 1 to 20% by weight based on the fiber.

Ordinarily, a natural leather can be used without impregnation with an elastomer (PU, in this invention, elastomer is not always restricted to PU. For example, acrylic rubber, butadien rubber, natural rubber, silicone rubber, vinyl rubber) and gives high grade product. However, in case of an artificial leather, a high-grade product cannot be obtained without impregnation of a PU. This is due to the fact that the artificial leather is essentially different from the natural leather. In the natural leather, the fibers comprise branches entangled with one another and it seems not to be true that they are merely bonded together.

Accordingly, the relation of the fiber to the PU is very important and is one of important features of the present invention. This feature is not directly relevant to the colour or dyeing.

Furthermore, a PU has an important relation to a disperse dye or basic dye. When the fiber of the present invention is dyed with both the dyes in one bath, it is preferred that the reduction clearing after dyeing is carried out with a solution containing hydrosulfite and caustic soda. In this case, the strength of the component B is sometimes reduced to some extent, but the prominent effect of the present invention are not degraded at all.

The present invention is described in detail with references to the following examples that by no means limit the scope, usefulness and validity of the invention. Furthermore broader of the application field of the present invention will rather be suggested by these examples.

EXAMPLE 1

An islands-in-sea composite fiber was spun from PET having an IV value of 1.15 (as measured according to the method described above in the specification) as the core component A of the island component, a poly(ethyleneterepthalate/5-sodium sulfoisophthalate) copolymer (the content of the 5-SS being 2.43 mole% based on dimethylterephthalate) having an IV value of 0.58 as the sheath component B of the island component and a Poly (styrene/2-ethylhexyl acrylate) copolymer (the content of 2-ethylhexyl acrylate being 22 weight %) having an (eta bracket) value of 1.01 (as measured according to the method described below(A)) as the sea component C, by using spinneret having an island-in-sea structure including sheath and core in the island (see FIG. 1A of UK Patent Application No. 2,057,344) at a melting temperature of 295° C. The island/sea weight ratio was 57/43, and the core/sheath weight ratio ws adjusted to 0/100, 25/75, 35/65, 50/50, 65/35 or 100/0. Then, the spun fiber was cooled treated with an finishing agent and wound at a speed of 1280 m/min.

The (eta bracket) value of the sea component was measured according to the following method.

(A) To 0.5 g of the polymer was added 50 ml of toluene and the polymer was dissolved. The flow-down time was measured at the concentrations of 1X, 2/3X, 1/2X and 1/3X of it, respectively in a water bath maintained at 30° C. by a capillary tube viscometer and the relative viscosity (eta r) was determined, and the (eta bracket) value was determined by extrapolating according to the following formula:

$$(\textit{eta}\ \text{bracket}) = \lim_{c \text{ approaches to } o} (1/c)\log_e(\textit{eta}\ r)$$

The obtained undrawn fiber was drawn at 80° C. at a draw ratio of 2.98 and drawing speed of 60 m/min by using a hot liquid bath drawing machine to obtain a 150 d/36 f composite drawn yarn.

Figure 4:
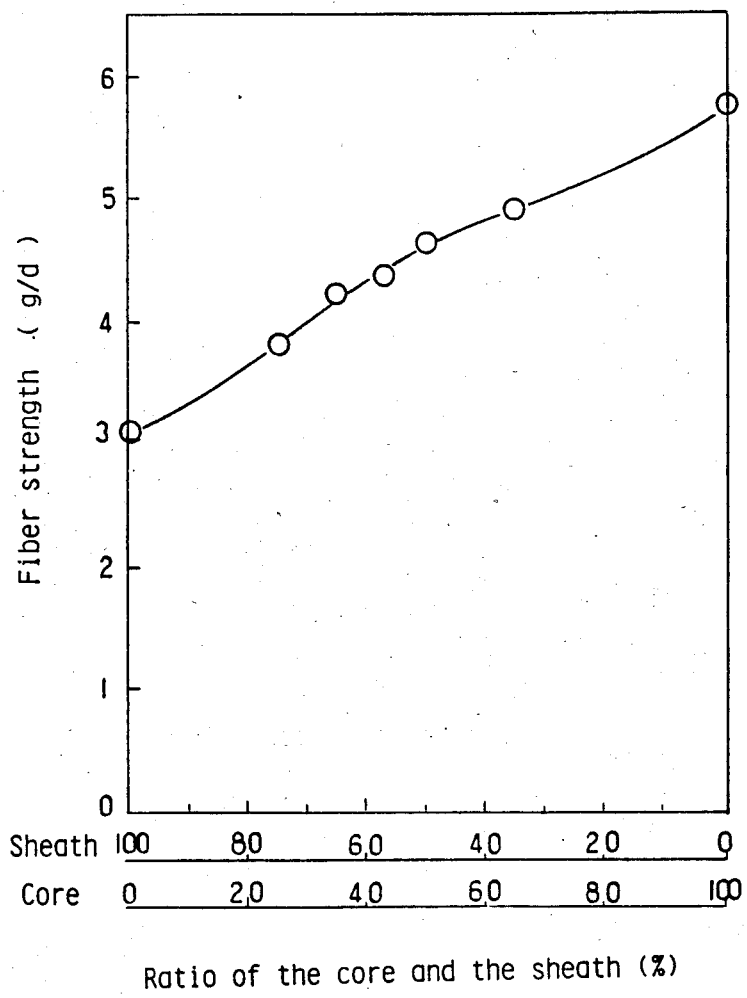
FIG. 4 is a diagram illustrating the relation between the ratio of the core and sheath components and the fiber strength, which is obtained in Example 1.

FIG. 4 illustrates the relation between the strength of the island component left after removing the sea component of the drawn yarn by carbon tetrachloride and the core/sheath ratio. As will be apparent from FIG. 4, in the fiber of the present invention, a sufficient strength can be maintained even though a polymer having a low strength is used as the sheath component.

On the other hand, the composite drawn yarn was formed into a knitted cylindrical fabric (sample hosiery), and the fabric was immersed in trichloroethylene, squeezed by a mangle and dried at 100° C. to obtain a knitted cylindrical fabric composed solely of the island component at a sea removal ratio of 99.5%.

The resulting knitted cylindrical fabric was treated in a circulating type high temperature dyeing machine and dyed with Aizen Cathilon Navy Blue CD-RLH(supplied by Hodogaya Kagaku Co.Ltd.) at a dye concentration of 20% owf and a dyeing temperature of 120° C. for 60 minutes. Acetic acid (0.6 g/l) sodium acetate (0.4 g/l) and Glauber salt (3 g/l) were used as auxiliary agents. The dyed fabric was washed with water and then washed with warm water containing acetic acid (0.2 g/l) and an anionic surfactant (Laccol PSK supplied by Meisei Kagaku Co. Ltd) (2 g/l) at 60° C. for 20 minutes. Then an antistatic agent (Silstat #1173 supplied by Sanyo Kasei Co. Ltd) and a softener (Babiner S-783 supplied by Marubishi Yuka Co. Ltd) were added. After that, the fabric was dried at 80° C.

Figure 5:
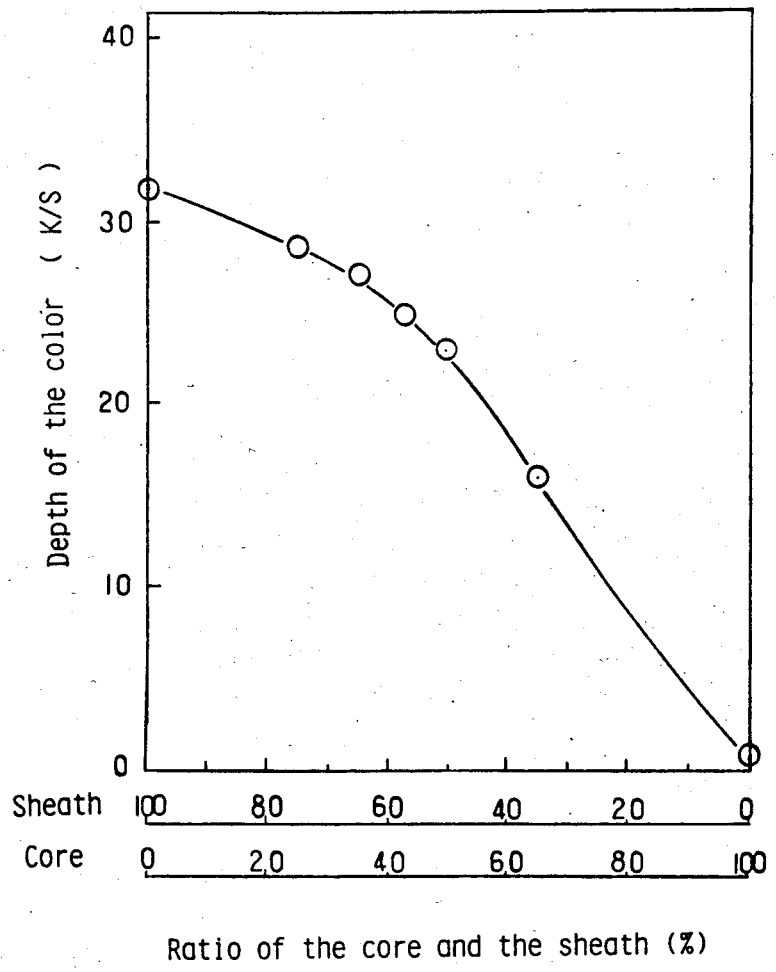
FIG. 5 is a diagram illustrating the relation between the ratio of core and sheath components and the depth of colour by cationic dye, which is obtained in Example 1.

The colour depth (K/S value measured at the wave length of maximum absorption respectively) of the so-obtained knitted cylindrical fabric was measured by using a spectrophotometer (Model Macbeth MS-2000 supplied by Kollmorgen Co. Ltd), where K/S is known as "function of KUBELKA-MUNK" and gives one of the measures of the colour depth. The obtained values of the respective sheath-core ratio was plotted to obtain FIG. 5. From FIG. 5, it was found that as the ratio of the sheath component is increased, the colour depth is enhanced. When FIGS. 4 and 5 are examined in combination, it was found that a sufficient colouring effect can be attained in the range where the strength of the sheath component can be reinforced. It was confirmed that as the ratio of the sheath component is increased, a brilliant and deep blue colour can be imparted to the knitted cylindrical fabric.

EXAMPLE 2

The undrawn yarn obtained in Example 1 (island/sea weight ratio=57/43, core/sheath weight ratio in the island component=25/75) was drawn by a two-staged hot liquid bath drawing machine at a preheating bath temperature of 55° C., a first liquid bath temperature of 80° C. and a second liquid bath temperature of 70° C. at a draw ratio of 3.15 and a drawing speed of 60 m/min, and the drawn yarn was crimped so that the crimp number was 12 crimps per inch.

The crimped yarn was sprayed with a silicone type fiber finishing agent, dried at 40° to 50° C. and cut into 51 mm by a cutting machine to obtain a raw fiber-1 having the following properties.

Fineness of composite fiber: 3.36 denier
Strength of composite fiber: 2.77 g/d
Elongation of composite fiber: 45.7%
Strength of island component: 3.90 g/d Elongation of island component: 47.2%
Number of crimp: 12.2 crimps per inch
Cut length: 51.1 mm
IV value of core component after removal of sheath from island: 0.783

The obtained raw fiber-1 was passed through a carding machine and cross-lapper to form a web having a weight of 160 g/m$^2$. Three of the so-formed webs were overlapped together and then needle-punched to obtain a non-woven fabric having a weight of 556 g/m$^2$ and apparent density of 0.213 g/cm$^3$ with a needle density of 4000 needles/cm$^2$.

The non-woven fabric was passed through hot water maintained at 85° C. and mangle-nipped with a certain clearance (0.75t t=thickness). The shrunk non-woven fabric was dried at 30° C. until the weight was not changed. The area shrinkage ratio was 27.2%.

The non-woven fabric was dipped in a so-called polyvinyl alcohol (referred to PVA hereinafter) bath having a concentration of 14% in water, which was maintained at 40° to 50° C., and was mangle-nipped, so that 25 parts of PVA was applied to 100 parts of the fiber. This was determined by measurement of the weight of sheet. Then, the fabric was once passed through a hot air-circulating dryer at 150° C. and was dried at 85° C. until the weight became constant.

Then, the fabric was dipped in trichloroethylene and nipped by a mangle with a certain clearance (0.65t) 35 times repeatedly, and the fabric was dried at 100° C. until the weight became constant. The sea component removal ratio was 99.3% by weight.

Then, the fabric was dipped into a dimethylformamide (referred to DMF hereinafter) solution of polyurethane having a concentration of 14% (containing carbonblack in an amount of 0.08% by weight based on the polyurethane solid) and mangle-nipped so that 47 parts of PU resin was applied to 100 parts of the fiber. Then, the fabric was dipped into a water bath maintained at 30° C. for two hours to coagulate the resin.

The obtained composite sheet was dipped into hot water maintaned at 85° C., was squeezed by a mangle to remove PVA and the solvent, and was then dried at 100° C. A sheet having a weight of 627 g/m$^2$ and the apparent density of 0.327 g/cm$^3$ was obtained.

The sheet was sliced into two halves by a slicing machine, and the surfaces of the sliced sheet were buffed by a belt sander buffing machine provided with a 100 mesh sand paper. A raised sheet having a weight of 250 g/m$^2$, and apparent density of 0.346 g/cm$^3$ and a thickness of 0.74 mm was obtained.

The sheet was treated in a circulating high temperature dyeing machine and dyed into a single colour with a cationic dye that is, Aizen Cathilon Red K-GLH (supplied by Hodogaya Kagaku Co. Ltd) (filled circle in FIG. 6), Aizen Cathilon Blue CD-RLH (supplied by Hodogaya Kagaku Co. Ltd) (filled square in FIG. 6) or Diacryle Yellow 3G-N (supplied by Mitsubishi Kasei Co. Ltd) (filled triangle in FIG. 6) at a dye concentration of 10, 15 or 30% owf and a dyeing temperature of 120° C. for 60 minutes. Acetic acid (0.6 g/l), sodium acetate (0.4 g/l) and Glauber salt (3 g/l) were used as dyeing auxiliary agents.

The dyed sheet was washed with water and dipped into water containing 0.2 g/l of acetic acid and 2 g/l of an anionic surface active agent (Laccol PSK supplied by Meisei Kasei Co. Ltd), which was maintained at 60° C. for 20 minutes. Then, an antistatic agent (Silstat #1173 supplied by Sanyo Kasei Co. Ltd) and a softener (Babiner S-783 supplied by Marubishi Yuka Co. Ltd) were added. After that the sheet was brushed along the raising direction and was then dried at 80° C.

For comparison, three sheets obtained by using PET alone for the island component were dyed respectively into a single colour with three disperse dyes, that is, Palanil Yellow 3G (supplied by BASF) (hollow triangle in FIG. 6), Resolin Blue BBLS (supplied by Bayer) (hollow square in FIG. 6) or Kayalon Polyester Light Red B-S (supplied by Nippon Kayaku Co. Ltd) (hollow circle in FIG. 6), at a dye concentration of 10, 15 or 30% owf and a dyeing temperature of 120° C. for 60 minutes respectively. Wet Softer AS (supplied by Ipposha Yushi Co. Ltd) (0.6 g/l), Mignol #4000N (supplied by Ipposha Yushi Co. Ltd) (0.5 g/l) and a 50% solution of a ½ mixture of acetic acid/sodium acetate (1.0 g/l) were used as auxiliary agents.

The each dyed sheet was washed with water and dipped into water containing 1.2 g/l of Sandet G-29 (supplied by Sanyo Kasei Co. Ltd), 0.9 g/l of hydrosulfite and 0.9 g/l of 36 Baume degree NaOH, which was maintained at 80° C., for 20 minutes. Then, antistatic agent (Silstat #1173 supplied by Sanyo Kasei Co. Ltd) and a softener (Babiner S-783 supplied by Marubishi Yuka Co. Ltd) were added. After that, each sheet was brushed along the raising direction and was then dried at 80° C.

Figure 6:
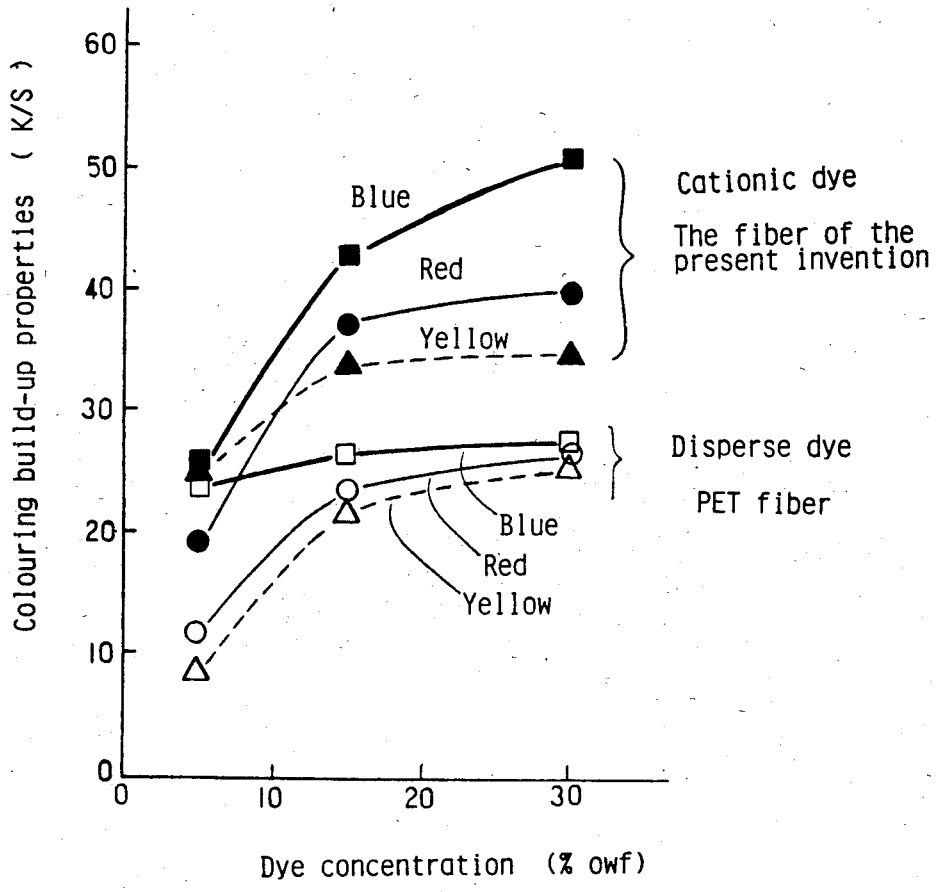
FIG. 6 is a diagram illustrating results of comparison of colouring build up properties of fibers of the present invention by a cationic dye at various dye concentrations with colouring build up properties of the fibers composed of PET alone by a disperse dye at various dye concentrations, which are obtained in Example 2.

The colour depth (K/S value) of each of the raised sheet dyed into the three primary colours with the cationic dyes was determined by using a spectrophotometer (Model Macbeth MS-2000). The relation between the colour depth and the dye concentration is shown in FIG. 6. From FIG. 6, It will readily be understood that the fiber of the present invention has an excellent colouring properties with respect to each of the three primary colours at each dye concentration.

EXAMPLE 3

A composite yarn was spun from PET chips having an IV value of 0.72 (as measured according to the method described in the specification) as the island component and polystyrene pellets having an (eta bracket) value of 0.665 and containing 5.0% by weight of polyethyleneglycol as the sea component, at a melt temperature of 285° C. by using a spinneret having a sea/island structure. The island/sea weight ratio was 57/43. The spun fiber was cooled, treated with an finishing agent and wound up at a speed of 1400 m/min.

The resulting undrawn yarn was drawn by a wet-heat drawing method at a heating steam temperature of 150° C., a draw ratio of 2.5 and drawing speed of 110 m/min. and the drawn yarn was crimped, so that crimp number was 12 crimps per inch. The crimped yarn was dried at 45° to 55° C. and was cut into 51 mm. A raw fiber-2 having the following properties was obtained.

Fineness of composite fiber: 3.76 denier
Strength of composite fiber: 2.45 g/d
Elongation of composite fiber: 53.5%
Strength of island component: 4.42 g/d
Elongation of island component: 82.8%
Crimp number: 11.5 crimps/inch
Cut length: 51 mm The raw fiber-2 was mixed with the raw fiber-1 obtained in Example 2 (island/sea weight ratio=57/43, core/sheath weight ratio in the island component=25/75) at a fiber-1/fiber-2 weight ratio of 70/30.

The obtained mixed raw fibers were passed through a carding machine and cross lapper to form a web having a weight of 160 g/m$^2$. Three of the so-formed webs were overlapped together and then needle-punched to obtain a non-woven fabric having a weight of 528 g/m$^2$ and an apparent density of 0.192 g/cm$^3$ with a needle density of 3000 needles/cm$^2$.

The non-woven fabric was passed through hot water maintained at 85° C. and mangle-nipped with a certain clearance (0.75t). The shrunk non-woven fabric was dried at 80° C. until the weight was not changed substantially. The area shrinkage ratio was 33.2%.

The non-woven fabric was dipped in PVA bath having a concentration of 12.5% in water, which was maintained at 40° to 50° C., and was mangle-nipped, so that 25 parts of PVA was applied to 100 parts of the fiber. Then, the fabric was once passed through a hot air-circulating drier at 150° C. and was dried at 85 C. until the weight became constant substantially.

Then, the fabric was dipped into trichloroethylene and nipped by a mangle with a certain clearance (0.65t) 35 times repeatedly, and the fabric was dried at 100° C. until the weight became constant. The sea component removal ratio was 99%.

Then, the fabric was dipped in a DMF solution of PU having a concentration of 14% (containing carbon black in an amount of 0.08% by weight based on the PU solid) and mangle-nipped, so that 47 parts of the PU resin was applied to 100 parts of the fiber. Then, the fabric was dipped into a water bath maintained at 30° C. for 2 hours to coagulate the resin.

The obtained composite sheet was dipped in hot water maintained at 85° C., was squeezed by a mangle to remove the PVA and the solvent for PU, and was then dried at 100° C. A sheet having a weight of 665 g/m$^2$ and an apparent density of 0.312 g/cm$^3$ was obtained.

The sheet was sliced into two halves by a slicing machine, and the surfaces of the sliced sheet were buffed by a belt sander buffing machine provided with a 100-mesh sand paper. A raised sheet having a weight of 238 g/m$^2$, an apparent density of 0.310 g/cm$^3$ and a thickness of 0.77 mm was obtained.

The sheet was treated in a circulating type high temperature dyeing machine (supplied by Hisaka Co. Ltd) and dyed with cationic dyes, that is, 8.57% owf of Diacryle Yellow 3G-N (supplied by Mitsubishi Kasei Co. Ltd), 4.28% owf of Aizen Cathilon Red K-GLH(supplied by Hodogaya Kagaku Co. Ltd) and 2.14% owf of Aizen Cathilon Blue CD-RLH(supplied by Hdogaya Kagaku Co. Ltd) at a temperature of 120° C. for 60 minutes. Acetic acid (0.6 g/l), sodium acetate (0.4 g/l) and Glauber salt (3 g/l) were used as dyeing auxiliary agents.

The dyed sheet was washed with water and dipped in water containing 0.2 g/l of acetic acid and 2 g/l of an anionic surface active agent (Laccoal PSK supplied by Meisei Kasei Co.Ltd), which was maintained at 60° C. for 20 minutes. Then, an antistatic agent (Silstat #1173 supplied by Sanyo Kasei Co. Ltd) and a softener (Babiner S-783 supplied by Marubishi Yuka Co. Ltd) were added. After that, the sheet was brushed along the raising direction and was then dried at 80° C.

In the resulting raised sheet, only the fiber of the island component having the sheath-core structure was deeply and brilliantly dyed into a moss green colour as the base colour, and the raised sheet had "mélange" (mixed) colours and good touch and feel of a high grade.

EXAMPLE 4

A composite fiber was spun from a poly(ethyleneterephthalate/5-SS)copolymer (5-SS content is 2.43 mole% based on dimethylphthalate) having an IV value of 0.58 (as measured according to the method described in the specification) as the island component and polystyrene having a (eta bracket) value of 0.665 as the sea component, at a temperature of 285° C. by using a spinneret having a "islands-in-sea" type structure. The island/sea weight ratio was 80/20. The spun fiber was cooled, treated with finishing agent and taken up at a speed of 1280 m/min.

The resulting undrawn yarn was drawn by a wet-heat drawing method at a heating steam temperature of 150° C., a draw ratio of 2.85 and a drawing speed of 80 m/min., and the drawn yarn was crimped, so that the crimp number was 14 crimps/inch. The crimped yarn was dried at 45° to 55° C. and was cut into 51 mm. A raw fiber-3 having the following properties was obtained.

Fineness of composite fiber: 3.27 denier
Strength of composite fiber: 2.41 g/d
Elongation of composite fiber: 44.6%
Strength of island component: 3.04 g/d
Elongation of island component: 78.7%
Crimp number: 13.5 crimps/inch
Cut length: 51.3 mm The raw fiber-2 obtained in Example 3 was mixed with the raw fiber-1 obtained in Example 2 at a fiber-1/fiber-2 weight ratio of 0/100,30/70,70/30 or 100/0.

The obtained mixed fibers were passed through a carding cross lapper and then needle-punched. A non-woven fabric F-1 having a weight of 540 to 568 g/m$^2$ and an apparent density of 0.18 to 0.208 g/cm$^3$ with a needle density of 3000 to 3500 needles/cm$^2$ was obtained.

The raw fiber-3 was mixed with the raw fiber-2 obtained in Example 3 at a fiber-3/fiber-2 weight ratio of 30/70, 70/30 or 100/0.

The obtained mixed fibers were passed through a carding machine, cross lapper and then needle-punched. A non-woven fabric F-2 having a weight of 530 to 560 g/m$^2$ and an apparent density of 0.185 to 0.207 g/cm$^3$ with a needle density of 3000 to 3500 needles/cm$^2$ was obtained.

Figure 7:
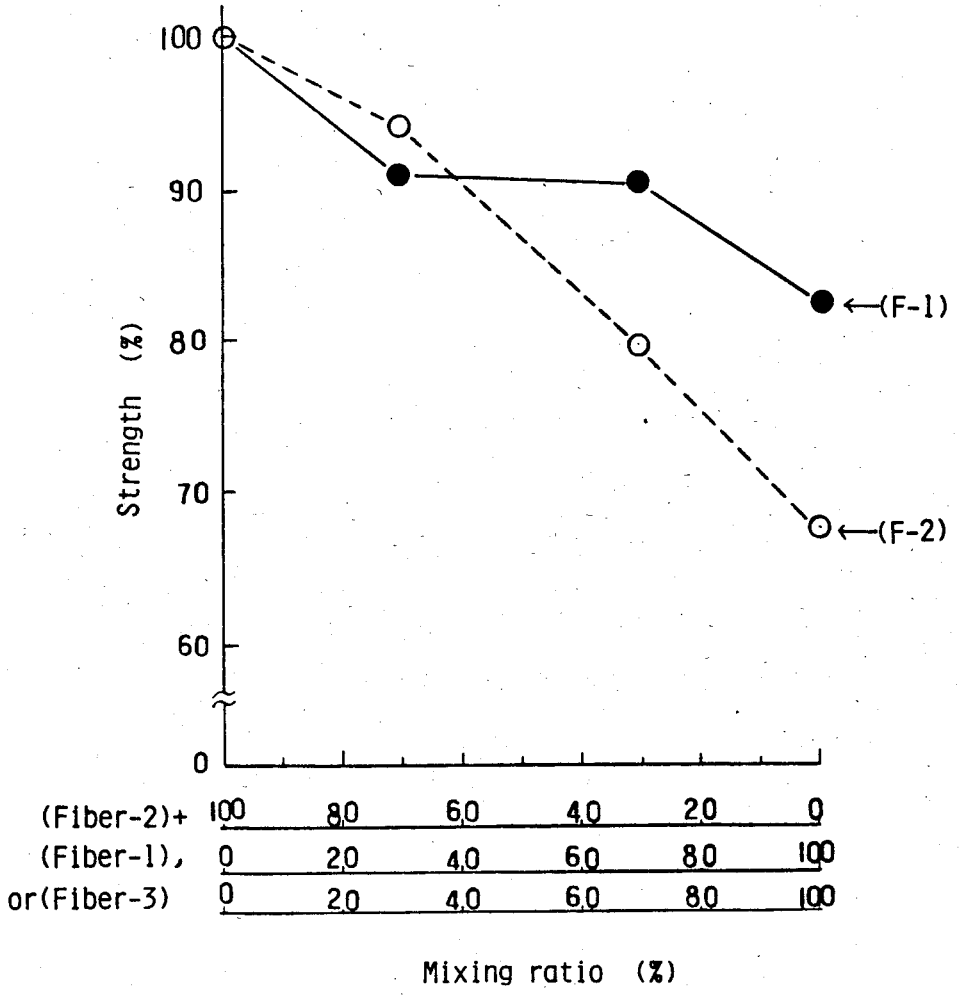
FIG. 7 is a diagram illustrating strength characteristics of felts before removing sea component prepared by mixing fibers of the present invention with PET fibers at various mixing ratio (strength characteristics of felts prepared by mixing fibers formed solely of the sheath component with PET fibers at various mixing ratios are simultaneously shown), which are obtained in Example 4.

The tensile strengths of each of the non-woven fabrics F-1 and F-2 were measured by using tensile testing machine ("Tensilon" by Tokyo Seiki Co. Ltd) The obtained results are plotted in FIG. 7 according to following manner. In FIG. 7, the relative values (strength retention ratios), calculated based on the supposition that the strength of the non-woven fabric by using the raw fiber-2 alone is 100%, are shown.

From FIG. 7, it was found that when the raw fiber-3 prepared by using the poly(ethyene terephthalate/5-sodium sulfoisophthalate)copolymer (the 5-sodium sulfoisophthalate content being 2.43 mole% based on dimethylterephthalate) alone as the island component is mixed, the strength retention ratio of the non-woven fabric is reduced with increase of the mixing ratio of the raw fiber-3 and when the raw fiber-3 alone is used (the ratio of the fiber-3 is 100%), the strength retention ratio is drastically reduced. In contrast, when the raw fiber-1 including an island component having a sheath/core structure according to the present invention was mixed, even if the raw fiber-1/raw fiber-2 weight ratio was changed to 70/30 from 30/70, the strength retention ratio of the non-woven fabric was reduced only slightly. Thus, it was confirmed that the fiber of the present invention is very excellent.

COMPARATIVE EXAMPLE

A composite fiber was spun in the same manner as described in Example 1 except that PET having an IV value of 0.53 (containing 0.5 mole% of Boric acid in order to increase apparent melt viscosity and spinnability) was used as the core component of the island component, the island/sea weight ratio was 57/43 and the core/sea ratio in the island component was 25/72. Then, the spun yarn was drawn at a draw ratio of 2.98 according to the drawing method described in the Example 2 the strength of the island component of the obtained drawn yarn was below 3.0 g/d and bad in strength. IV value of core component after removal of sheath was about 0.50.

EXAMPLE 5

A three-component fiber having a sectional structure shown in FIG. 2 was formed into a felt. The composition and physical properties are as follows.

Component A: 32 parts by weight of PET
Component B: 25 parts by weight of PET containing 5-SS units in an amount of 2.43 mole % based on the total acid component
Component C: 43 parts by weight of polystyrene copolymerized with 22 wt.% of 2-ethylhexylacrylate
Fiber length: about 51 mm.
Fineness of fiber: 3.8 denier
Crimp number: about 16 crimps/25.4 mm.
Strength of composite fiber AB: about 4.5 g/d
Formation of felt: needle punching method
Base weight of felt: 650 g/m$^2$ The felt was immersed in boiling water (85° C.), squeezed by a mangle and then dried.

A solution containing 13.5% by weight of partially saponified PVA was applied to the felt in an amount of about 26% by weight based on the composite fiber AB. Then, the felt was sufficiently washed with trichloroethylene and a DMF solution containing 13.5% by weight of PU was impregnated and coagulated in warm water.

The PVA was removed, and the felt was washed with hot water, dried, sliced into halves and buffed.

The buffed felt was dyed under the following conditions.

Dyeing Bath

3% owf of Aizen Cathilon Blue CD-FBLH (cationic dye)
0.6 g/l of acetic acid
0.45 g/l of sodium acetate
3 g/l of anhydrous Glauber salt
Bath Ratio: 1:50
Dyeing temperature and time: at 120° C. for 60 min.
Washing after dyeing: 2 g/l of Laccol PSK (anionic surface active detergent supplied by Meisei Kasei Co.)., bath ratio of 1:50, treatment temperature of 60° C., treatment time of 20 min., and subsequent hot water washing and water washing.

The dyed felt had a longitudinal tensile strength of 0.0258 Kg/weight (g/m$^2$) cm. of width. For comparison, the above procedures were repeated by using the component B alone for the island component. The strength of the fiber was 2.69 g/d and the longitudinal tensile strength of the dyed felt was 0.0138 Kg/weight (g/m$^2$) cm of width. Thus, it was found that comparative product was inferior in physical properties and the product according to the present invention was excellent in the physical properties.

Being brilliant far from a product prepared by using PET alone as the fiber component, the product of the present invention had a softer touch and a better hand and was dyed brilliantly in a blue colour, and the colour depth of the dyed product of the present invention was much higher than the depth of the dyed product prepared in the same manner except for dyeing with disperse dye by using the component PET alone.

EXAMPLE 6

A raw felt before the dyeing operation, which was obtained in Example 2, were dyed under the following dyeing conditions 1,2 or 3.

Dyeing Condition 1

Dyeing bath: 15% owf of cationic dye (Estrol Black BL supplied by Sumitomo Kagaku Co. Ltd), 0.6 g/l of acetic acid (90%), 0.15 g/l of sodium acetate, 3 g/l of anhydrous Glauber salt.
Bath ratio: 1:50
Dyeing temperature: 120° C.
Dyeing time: 60 min.
Washing after dyeing: 2 g/l of Laccol PSK, treatment temperature of 60° C., treatment time of 20 min.

Dyeing Condition 2

Dyeing bath: 15% owf of cationic dye (Estrol Black BL), 15% owf of disperse dye (Samaron Black BBL liquid supplied by Hoechst), 0.6 g/l of acetic acid (90%), 0.15 g/l of sodium acetate, 3 g/l of anhydrous Glauber salt, 4% owf of surface active agent (Ospin 7000CD supplied by Tokaiseiyu Co).
Bath ratio: 1:50
Dyeing temperature: 120° C.
Dyeing time: 60 min.
Washing after dyeing
(a) First washing (reduction clearing): 3.6 g/l of hydrosulfite, 3.6 g/l of caustic soda (48 Baume degree), 1.2 g/l of surface active detergent (Sandet G-29 supplied by Sanyo Kasei Co), treatment temperature of 80° C., for 20 min. (PH-value 13.2).
(b) Second Washing (soaping): 2 g/l Laccol PSK(anionic surface active detergent), at 60° C. for 20 min.

Dyeing Condition 3

Dyeing bath: 15% owf of disperse dye (Samaron Black BBL Liquid), 0.45 g/l (acetic acid), 0.6 g/l (sodium acetate), 0.5 g/l (Mignol#4000N dye levelling agent by Ipposya Yushi Co)
Bath ratio: 1:50, temperature and time; at 120° C. for 60 min.
Reduction clearing: 3.6 g/l (hydrosulfite). 3.6 g/l (caustic soda 48 Baume degree), 1.2 g/l (Sandet G-29), at 80° C. for 20 min.

Under each of the dyeing conditions 1,2 and 3, hot water washing and water washing were sufficiently conducted.

Among suede-like artificial leathers prepared by the above dyeing condition 3, less substantial difference of the strength was observed, and these products were compared with each other with respect to the colour depth and brilliance. The obtained results were shown in Table 1.

TABLE 1

| dyeing condition | colour depth brightness | colour depth visual judgement | brilliance | general evaluation |
|---|---|---|---|---|
| 1 | 14.1 | deep-slightly light | very brilliant | good |
| 2 | 12.7 | very deep | brilliant | good |
| 3 | 15.0 | slightly light | not brilliant | bad |

It was found that the suede-like artificial leather obtained by using a cationic dye alone or in combination with a disperse dye according to the present invention was excellent in the hue.

What is claimed is:

1. A composite sheet comprising a fabric containing fiber components impregnated with polyurethane, in which all or parts of the fiber components comprise ultrafine composite fibers having a fineness of 0.5 denier or less, wherein said ultrafine composite fibers comprise a sheath component and a core component, the sheath component is mainly composed of a polyester copolymerized with a sulfoisophthalate selected from the group consisting of 5-sodium sulfoisophthalate, 5-lithium sulfoisophthalate and 5-potassium sulfoisophthalate, and the core component is composed of a polyester selected from the group consisting of polyethylene terephthalate having an IV value of 0.75 to 1.2 and polybutylene terephthalate having an IV value, of 0.85 to 2.5, which core component is free of said sulfoisophthalate or contains sulfoisophthalate at a ratio smaller than in the sheath component.

2. A composite sheet as claimed in claim 1, wherein at least the sheath component is dyed with at least a cationic dye.

3. A composite sheet as claimed in claim 1, wherein at least the sheath component is dyed with at least a disperse dye and at least a cationic dye.

4. A composite sheet as claimed in claim 1, wherein at least said sheath component is dyed with at least a disperse dye.

* * * * *

UNITED STATES PATENT AND TRADEMARK OFFICE

CERTIFICATE OF CORRECTION

PATENT NO. : 4,604,320

DATED : August 5, 1986

INVENTOR(S) : Miyoshi Okamoto, Hiromichi Iijima & Akito Miyoshi

It is certified that error appears in the above-identified patent and that said Letters Patent is hereby corrected as shown below:

Column 15, line 16, delete "30°" and insert --80°--.

Signed and Sealed this

Twenty-first Day of April, 1987

*Attest:*

DONALD J. QUIGG

*Attesting Officer*

*Commissioner of Patents and Trademarks*